US009004965B1

(12) United States Patent
Anderson

(10) Patent No.: US 9,004,965 B1
(45) Date of Patent: Apr. 14, 2015

(54) FORWARD FACING ROWING APPARATUS

(71) Applicant: Ron Anderson, Newport Beach, CA (US)

(72) Inventor: Ron Anderson, Newport Beach, CA (US)

( * ) Notice: Subject to any disclaimer, the term of this patent is extended or adjusted under 35 U.S.C. 154(b) by 0 days.

(21) Appl. No.: 14/203,172

(22) Filed: Mar. 10, 2014

(51) Int. Cl.
*B63H 16/10* (2006.01)
*B63H 16/04* (2006.01)

(52) U.S. Cl.
CPC ..... *B63H 16/10* (2013.01); *B63H 16/04* (2013.01)

(58) Field of Classification Search
CPC ..... B63H 16/06; B63H 16/107
USPC ..... 440/104–107
See application file for complete search history.

(56) References Cited

U.S. PATENT DOCUMENTS 287,088 A * 10/1883 Beckers ..... 440/104
2,083,004 A * 6/1937 Clark ..... 440/104
3,324,490 A * 6/1967 Jewett ..... 440/101
3,951,095 A * 4/1976 Jewett ..... 440/104
5,127,859 A * 7/1992 Rantilla ..... 440/104
6,796,863 B1 * 9/2004 Oathout ..... 440/104
6,939,186 B1 * 9/2005 Kuckes ..... 440/104

* cited by examiner

*Primary Examiner* — Lars A Olson
*Assistant Examiner* — Jovon Hayes
(74) *Attorney, Agent, or Firm* — Steins & Associates, P.C.

(57) ABSTRACT

A Forward Facing Rowing Apparatus and the associated vessel. The apparatus has a single attachment point and pivot assembly for supporting the oars. A built-in set of leaf spring elements reduce user effort by providing lifting force to raise the oar members. The apparatus is deployable on vessel hulls of virtually unlimited configuration, while still offering proper rowing leverage between the user's hands and the blades without the need for supplemental mounting systems or outriggers. The apparatus is stowable within the center area of the vessel hull. The positioning of the central pivot point for the oars can be adjusted along the axis of the vessel hull so that it can accommodate a wide variety of user preferences. An alternate design includes a foot-assisted sliding trolley mounting assembly that enables the user to add leg/foot power to the stroking motion. Furthermore, the apparatus is removable from the hull for transport or storage.

18 Claims, 14 Drawing Sheets

FORWARD FACING ROWING APPARATUS

This application is filed within one year of, and claims priority to Provisional Application Ser. No. 61/775,165, filed Mar. 8, 2013.

BACKGROUND OF THE INVENTION

1. Field of the Invention

This invention relates generally to vessel propulsion systems and, more specifically, to a Forward Facing Rowing Apparatus.

2. Description of Related Art

Conventional human-powered rowing of boats places the operator facing away from the direction of travel and require that the operator continually turn to look or use mirrors to see where they are going. Failure to continually do so can cause collisions or boat groundings. While using a paddle to propel the boar allows the operator to face in the direction of travel it also requires more effort because there is no mechanical advantage from a boat-mounted fulcrum is available. Paddling also allows just one paddle blade to be in the water at a time (this limits the force per stroke available to propel the boat).

Documented examples of forward facing rowing apparatuses date back to the beginning years of the U.S. Patent Office. They generally fall into three categories: those reversing the direction of conventional oars, those using forward-activated sweep oars and those that use the user's legs to assist in the stroking. The following U.S. patents are those considered to be the most relevant to the patentability of Applicant's design. Rantilla, U.S. Pat. No. 5,127,859 does have a near-central pivot point in the vessel (within the field of vision) and spring-biased lifting elements, however, it does not suggest a mounting point at the hull bottom, nor does it suggest curved oar members to increase user leverage. Beckers, U.S. Pat. No. 287,088 also suggests spring-lifted oars at two pivot points. like Rantilla does not suggest the hull-bottom mounting location, nor the arcuate oar members.

C. H. Clark, U.S. Pat. No. 2,083,004 does not suggest hull-bottom mounting location, arcuate oar members, or even the upwardly—biasing springs.

Jewett, U.S. Pat. No. 3,951,095 does disclose arched oars, but does not suggest a single mounting/pivot point located at the bottom of the hull.

Finally, H. A. Jewett, U.S. Pat. No. 3,324,490 discloses a forward-facing rowing mechanism that is quite complex, to the point where it is difficult to discern how the mechanism operates.

What is needed, then, is a mechanically simple, lightweight and durable rowing apparatus that incorporates a single, centralized pivot point located at the hull bottom, and spring-lifted arcuate oar members that permits the operator to face towards the bow of the vessel while rowing.

SUMMARY OF THE INVENTION

In light of the aforementioned problems associated with the prior devices, it is an object of the present invention to provide a Forward Facing Rowing Apparatus and associated vessel. The apparatus should have a single attachment point and pivot assembly for supporting the oars. A built-in set of leaf spring elements should reduce user effort by providing lifting force to raise the oar members. The apparatus should be deployable on vessel hulls of virtually unlimited configuration, while still offering proper rowing leverage between the users hands and the blades without the need for supplemental mounting systems or outriggers. It is a further object that the apparatus be stowable within the center area of the vessel hull. The positioning of the central pivot point for the oars should be adjustable along the axis of the vessel hull so that it can accommodate a wide variety of user preferences. Additionally, there should be an alternate design that includes a foot-assisted sliding trolley mounting assembly that would enable the user to add leg/foot power to the stroking motion.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Forward Facing Rowing Apparatus.

Figure 1:
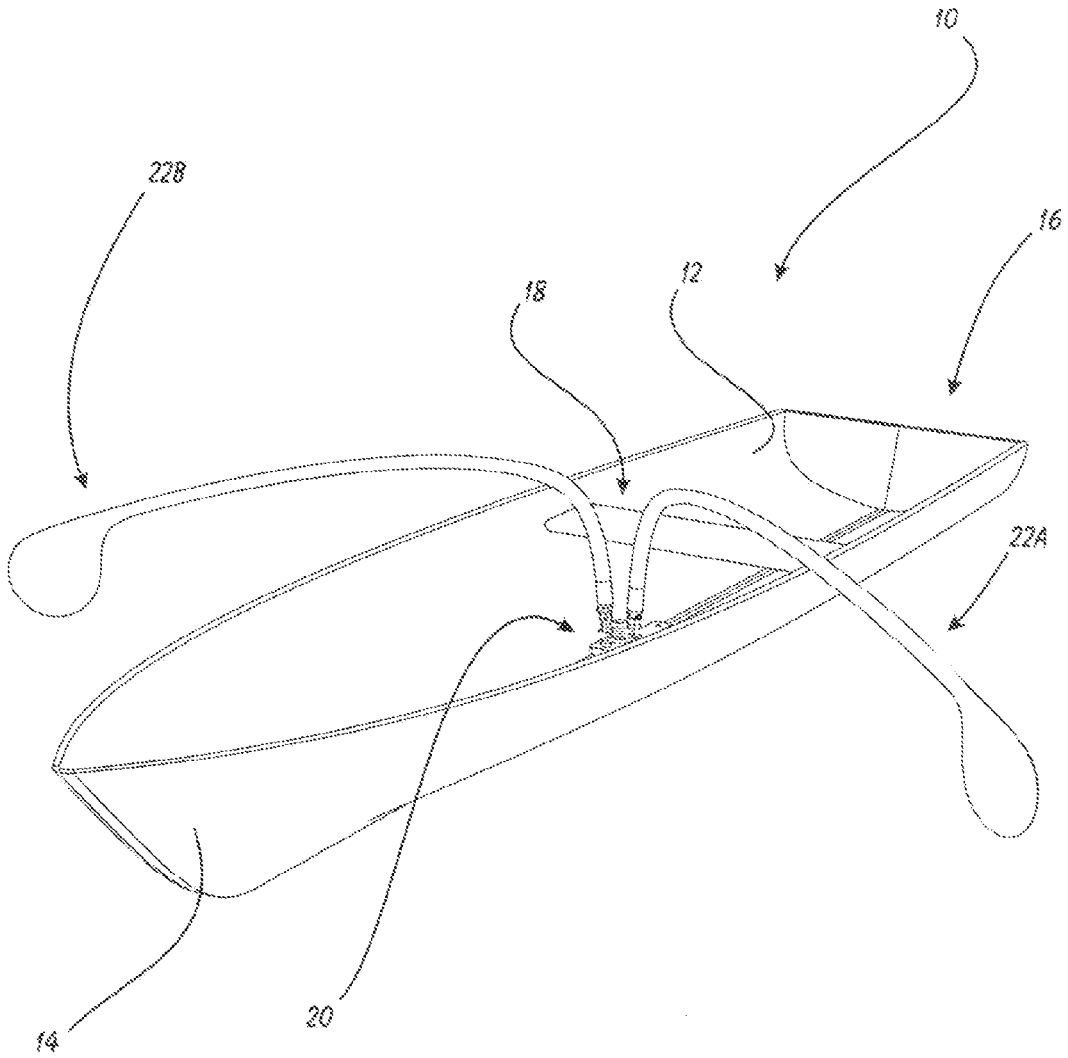
FIG. 1 is a perspective view of a preferred embodiment of a forward-rowable boat of the present invention.

The present invention can best be understood by initial consideration of FIG. 1.[1] FIG. 1 is a perspective view of a preferred embodiment of a forward-rowable boat 10 of the present invention. As its name suggests, the boat 10 is equipped with a sophisticated oar mechanism that permits the user to face forward while rowing the boat 10. This conventional boat 10 comprises an open hull 12 defined by a bow 14 and stern 16 at opposing ends. The user's seat 18 is typically located at approximately the mid-point between the stern 16 and bow 14. The forward-facing rowing apparatus (or assembly) 10 is attached to the bottom of the hull 12 just forward of the seat 18 (and aft of the bow 14). Testing has revealed that the mounting point for the apparatus 20 is optimally below the normal location of the person's knees when seated on the seat 18. As will be discussed below, the position is somewhat adjustable to accommodate different body types. As shown, left and right oar members 22A, 22B extend from a central pivot point.

[1] As used throughout this disclosure, element numbers enclosed in square brackets [ ] indicates that the referenced element is not shown in the instant drawing figure, but rather is displayed elsewhere in another drawing figure.

Figure 2:
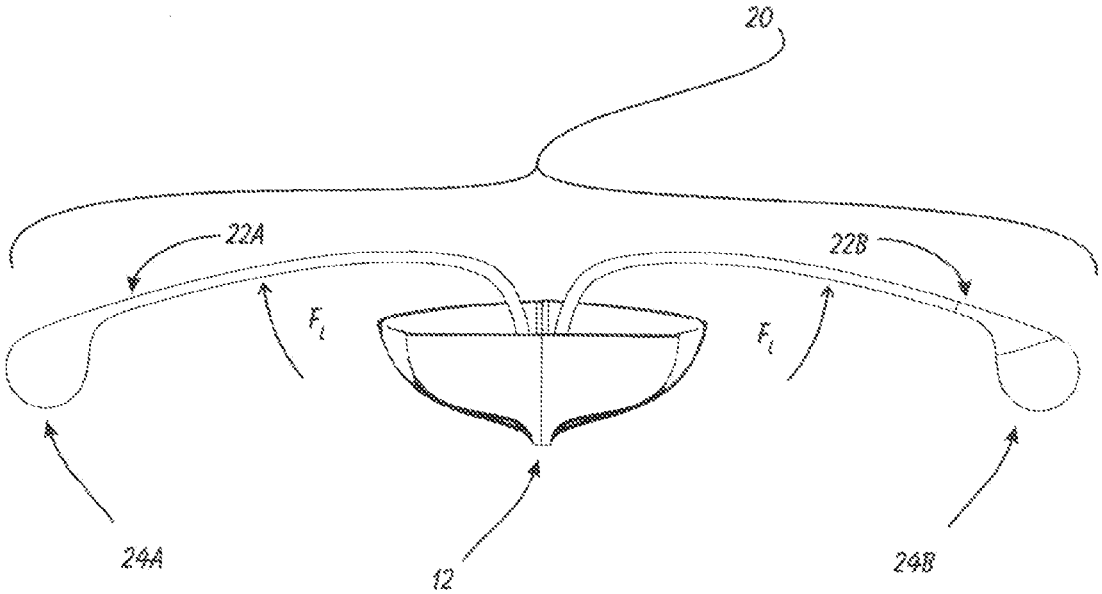
FIG. 2 is a back view of the boat of FIG. 1.

It should be understood that the forward-facing rowing apparatus 20 of the present invention is intended to be installable into virtually any conventional boat design, including but not limited to: inflatable and folding boats, kayaks, canoes, surf skis. Furthermore, fishing, swamp and paraplegic-accommodating vessels are contemplated (however the oar members 22 may take on a variety of different shapes in order to provide a more vertical blade entry into the water, and at a location closer to the side of the vessel). Additionally, seating two-abreast could also be accommodated with a slightly modified version of the depicted example design. FIG. 2 continues the description of the instant design.

Figure 3:
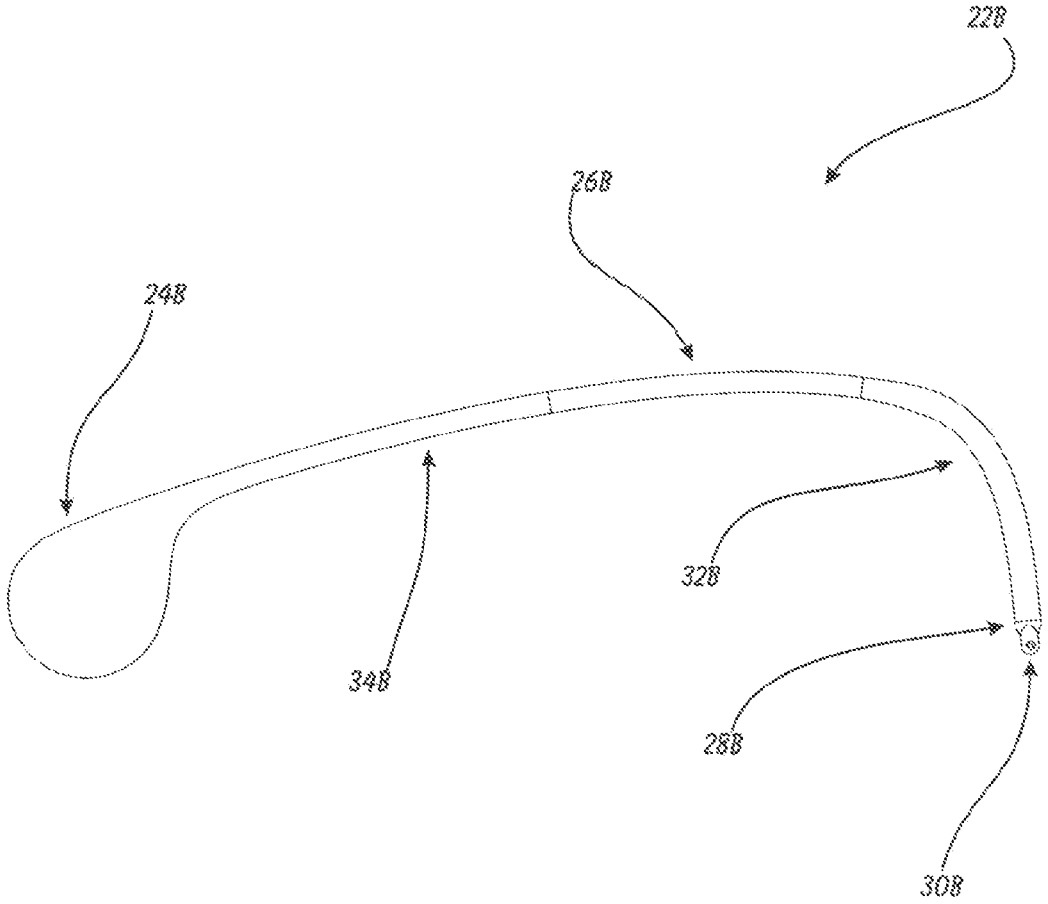
FIG. 3 is a front view of a preferred oar member of the boat of FIGS. 1 and 2.

FIG. 2 is a back view of the boat 10 of FIG. 1. The forward-facing rowing apparatus 20 has a pair of oar members 22A, 22B that each terminate in blades 24A, 24B on either side of the hull 12. A critical feature of the instant invention is that the oar members 22A, 22B of the apparatus 20 are biased upwardly by the mechanism of the apparatus 20, as will discussed in more depth below in connection with other drawing figures. These lifting forces $F_L$ provide a mechanical advantage to the user that results in much less effort being expended in order to lift the blades 24A, 24B from the water. In fact, it is preferred that the forces are sufficient to raise the blades 24A, 24B clear of the water when the oar members 22A, 22B are left to being self-supported by the apparatus 20 (thereby reducing the possibility of "crabbing"). The user needs simply to apply slight downward pressure on the oar members 22A, 22B in order to dip the blades 24A, 24B into the water. The forces created by the rowing motion will thereafter provide sufficient downward force to keep the blades 24A, 24B submerged sufficiently for the propulsion stroke. FIG. 3 depicts additional features of the instant design.

FIG. 3 is a front view of a preferred oar member 22B of the boat [10] of FIGS. 1 and 2. While only the right oar member 22B is depicted here, it should be understood that the structure of both right and left oar members are identical (but mirror images of one another).

The shape of the oar members 22A, 22B will be customized for each vessel application, but generally consists of a slight upwards arc (to clear the operators' legs), transitioning to a tighter radius curve down towards the attachment point in the vessel. The oar member 22B comprises an inboard shaft portion 32B terminating in an end cap 28B at its proximal (relative to the vessel) end. The end cap 28B preferably has a pivot aperture 30B formed therethrough to attach to the support mechanism for the apparatus [20] as will be discussed in more detail below.

The inboard shaft portion 32B transitions into the hand grip portion 26B, which as shown here, is a wide (ergonomically-angled) segment of the oar member 22B. Grip tape or coating may be applied to this section in order to aid the user in maintaining a solid grasp on the oar member 22B. The hand grip portion 26B transitions at its distal end into the outboard shaft portion 34B, to which the blade 24B is attached (or formed as an integral part thereof).

It is expected that the inboard shaft portion 32B, the hand grip portion 26B and the outboard shaft portion 34B (and potentially even the blade 24B) will be made from a unitary piece of material. All components must be constructed of a material which has sufficient strength to endure the axial, shear, bending and torsional forces applied to the oar members 22A, 22B during rowing will not suffer catastrophic failure (including fatigue from long-term use).

Figure 4A:
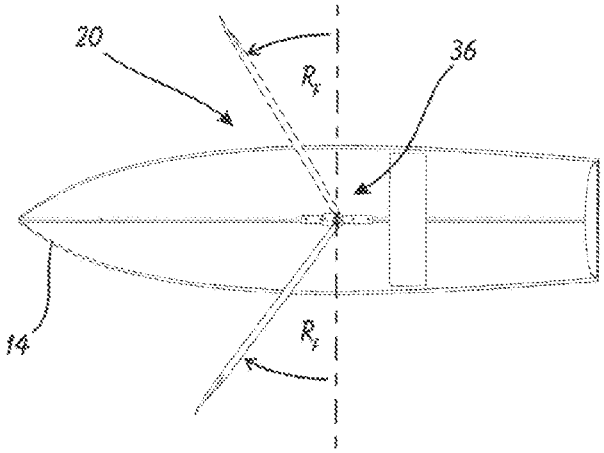
FIGS. 4A, 4B and 4C depict top views of the boat of FIGS. 1 and 2 provided to illuminate the rowing sequence followed by a user of the device of the present invention.
Figure 4B:
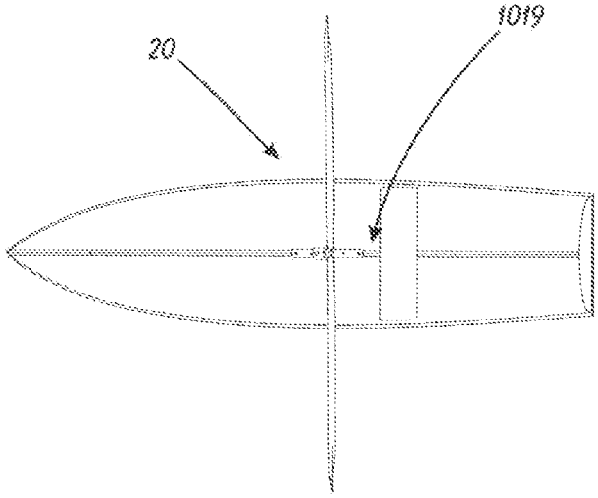
Figure 4C:
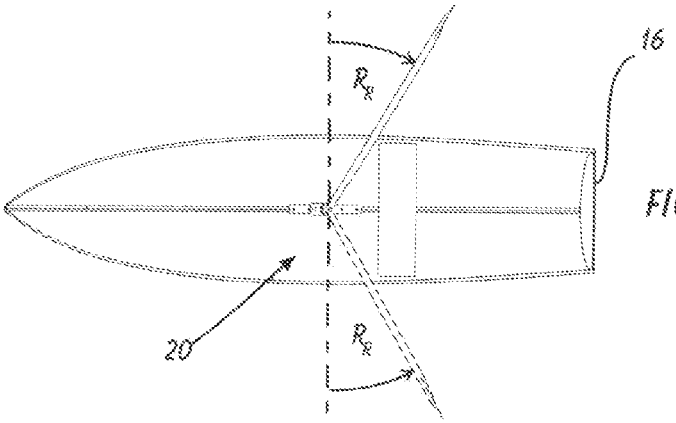

The design of the blade 22B does not provide for "feathering" (i.e. tilting the blade forward or backwards, as related to the vessel) the blade during the rowing motion. The shaped blade 22B is instead angled permanently forward, such that as the oar member 22B is pulled (rearward) by the user, the blade 22B will be pulled deeper into the water. It follows that on the recovery stroke (i.e. when the user is pushing the oar member 22B forward), the blade's angle will force the blade to be pushed up out of the Water (resulting from the relative motion through the water). FIGS. 4A-4C will perhaps clarify any confusion regarding the novel rowing motion.

FIGS. 4A, 4B and 4C depict top views of the boat of FIGS. 1 and 2 provided to illuminate the rowing sequence followed by a user of the device of the present invention. FIG. 4A depicts the vessel with the apparatus 20 in the initialize position (i.e. the rowing stroke is beginning) The user has exerted forward rowing force ($R_F$) against the oar members (collectively 24) until they are displaced forwardly from their rest position depicted by the dashed line passing through the central pivot point 36. The user then exerts rearward rowing force ($R_R$) against the oar members 24 until the oar members 24 pass through the rest position of FIG. 4B, and to the termination position (i.e. the rowing stroke has ended) shown in FIG. 4C. The user then re-asserts force $R_F$ so that the oar members 24 return to the initialize position.

Figure 5:
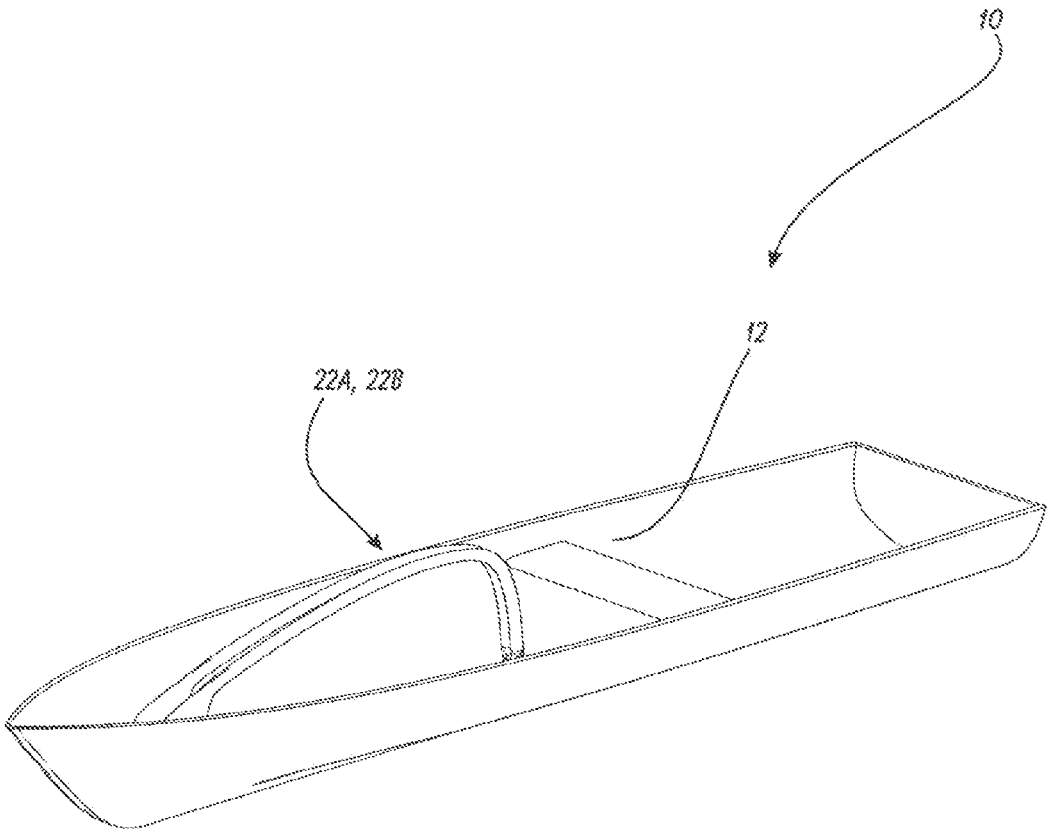
FIG. 5 is another perspective view of the boat of FIGS. 1, 2 and 4A-4C, depicting the oar members in the stowed position.

The result of these actions is to create propulsion in the direction of the bow 14 (forwardly), while the user is seated facing forwardly. The operator may stroke both oars together as in typical rowing, alternate the stroke (as in paddling), or stroke an individual oar to steer. To stow the oars the operator may rotate each oar individually so that they both face towards the front or back of the boat and be lowered to rest within the boat. When the oars are stowed together, a feat made possible by a single pivot design, they may also be rotated to the side to rest on a dock or launching area and used as a handle to assist in boarding the vessel. FIG. 5 depicts the oar members 22A, 22B in the stowed position within the hull 12. Now turning to FIG. 6, we can examine other critical aspects of the apparatus [20].

Figure 6:
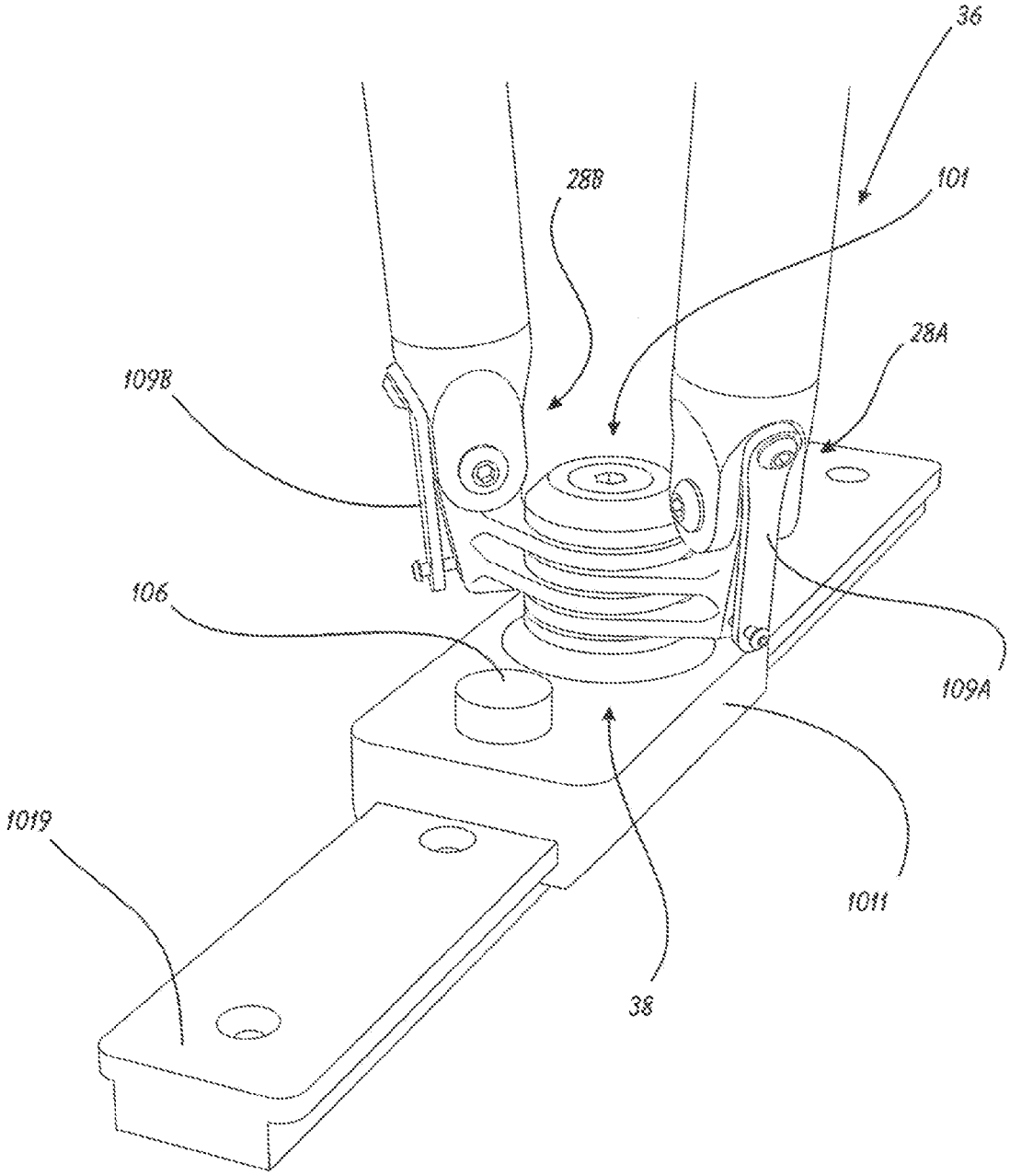
FIG. 6 is a partial front perspective view of the central hub assembly of the boat of FIGS. 1, 2, 4A-4C and 5.

FIG. 6 is a partial front perspective view of the central hub assembly 38 of the boat of FIGS. 1, 2, 4A-4C and 5. The end caps 28A, 28B attach independently to the central hub assembly 38 to create a central pivot point 36. The hub assembly extends from a base shuttle 1011, which is slidingly engaged with the mounting track 1019. The mounting track 1019 is fixedly attached to the hull [12] at a position just forward of the seat [18]. The sliding nature of this shuttle/track design permits the user to adjust the specific position of the central pivot point 36 of the oar members [22A, 22B] to accommodate a variety of rowing and body styles. A locking element 106 (such as a spring-loaded pin or threaded thumbscrew) is used to lock the position of the base shuttle 1011 along the mounting track 1019. The central hub assembly 38 extends upwardly from the base shuttle 1011. The assembly 38 is held together by a center pivot screw 101.

Figure 7:
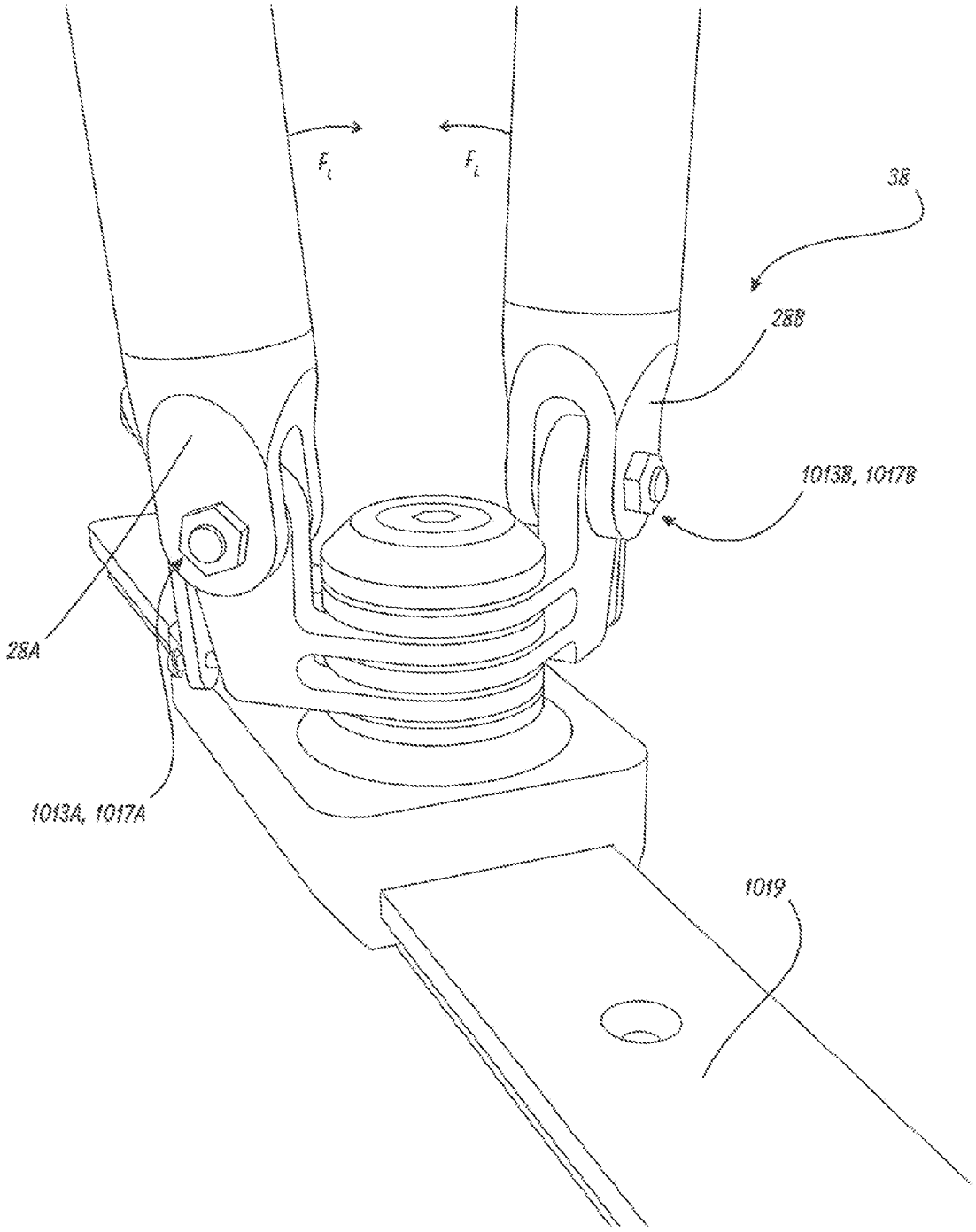
FIG. 7 is a partial rear perspective view of the central hub assembly of FIG. 6.

A very important aspect of the design of the apparatus [20] is the pair of lifting springs 109A, 109B. These are linkages made from spring-grade metal (small leaf springs), or composite laminate. On one end, each is attached to its respective end cap 28A, 28B. The opposing end biases against an element of the central hub assembly 38 (in a sliding fashion)—the leaf springs now bias against a roller wheel bolted to the pivot element. The bolts used to attach the springs 109A, 109B are adjustable so that the strength of the biasing force on the oar members [22A, 22B] can be adjusted. As shown in FIG. 7, the end caps 28A, 28B are attached to the central hub assembly 38 by pivot screws and nuts 1013A/1013B, 1017A, 1017B. This pivotal connection permits the oar in members [22A, 22B] to rotate up and down relative to the central hub assembly 38. The result is to create a biasing force that urges the inboard shaft portion [e.g. 32B] upwardly towards vertical, which forces the oar members [22A, 22B] upwardly [indicated by force $F_L$]. As discussed previously, this lifting force substantially reduces the level of effort required by the user. The specifics of the various individual elements of the central hub assembly are provided in FIG. 8.

Figure 8:
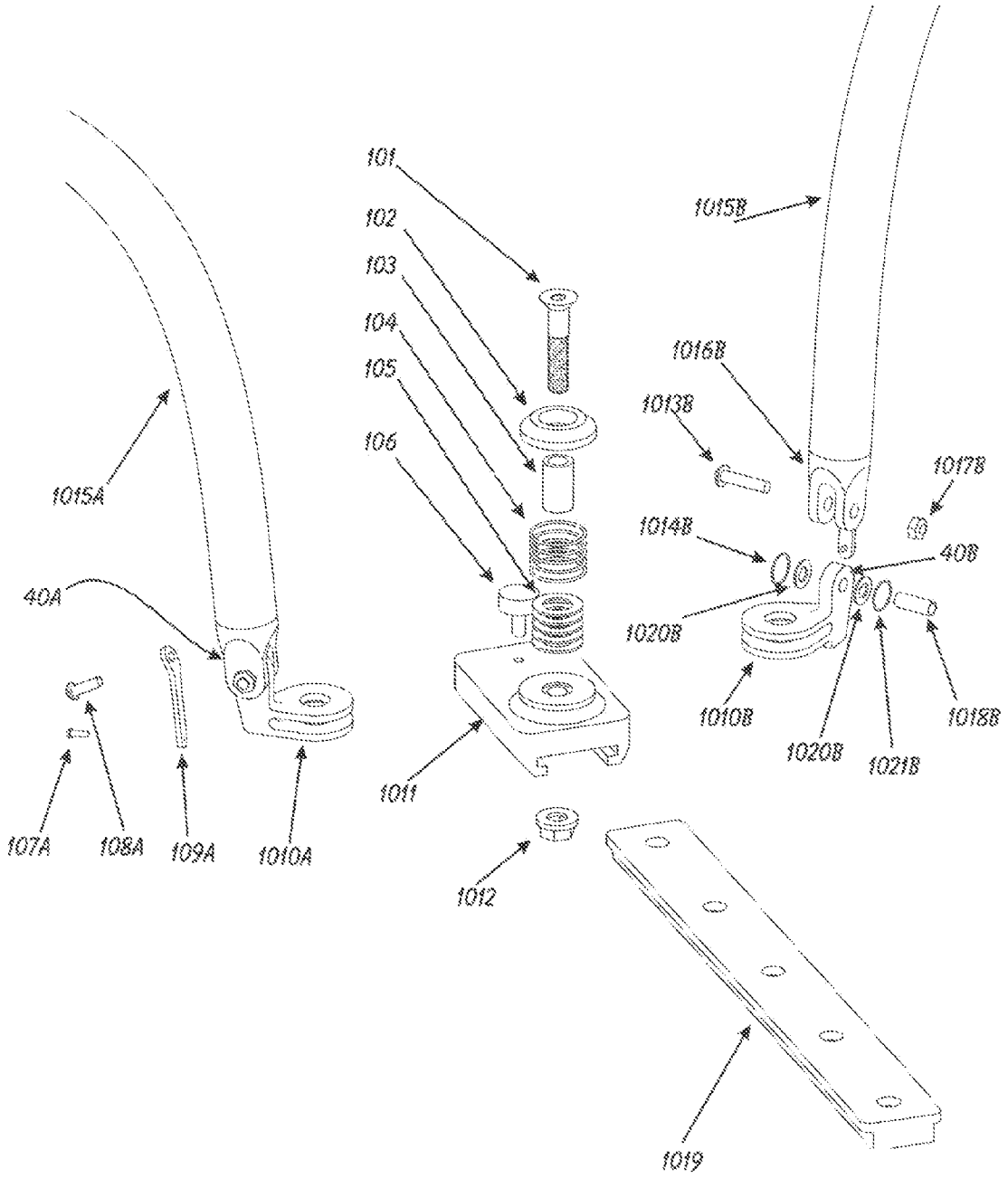
FIG. 8 is an exploded view of the central hub assembly of FIGS. 6 and 7.

FIG. 8 is an exploded view of the central hub assembly 38 of FIGS. 6 and 7. The central hub assembly 38 is, essentially, a hinge-type design of interlaced flat metal rings. This permits independent rotation of each oar member [22A, 22B] around the pivot screw 101. Oar mounting tabs 40A, 40B extend from their respective interlaced rings, where the end caps of the oar members pivotally attached (as discussed in connection with FIG. 6). The function and structure of the balance of the elements of the hub assembly 38 should otherwise be apparent to the reader.

Figure 9:
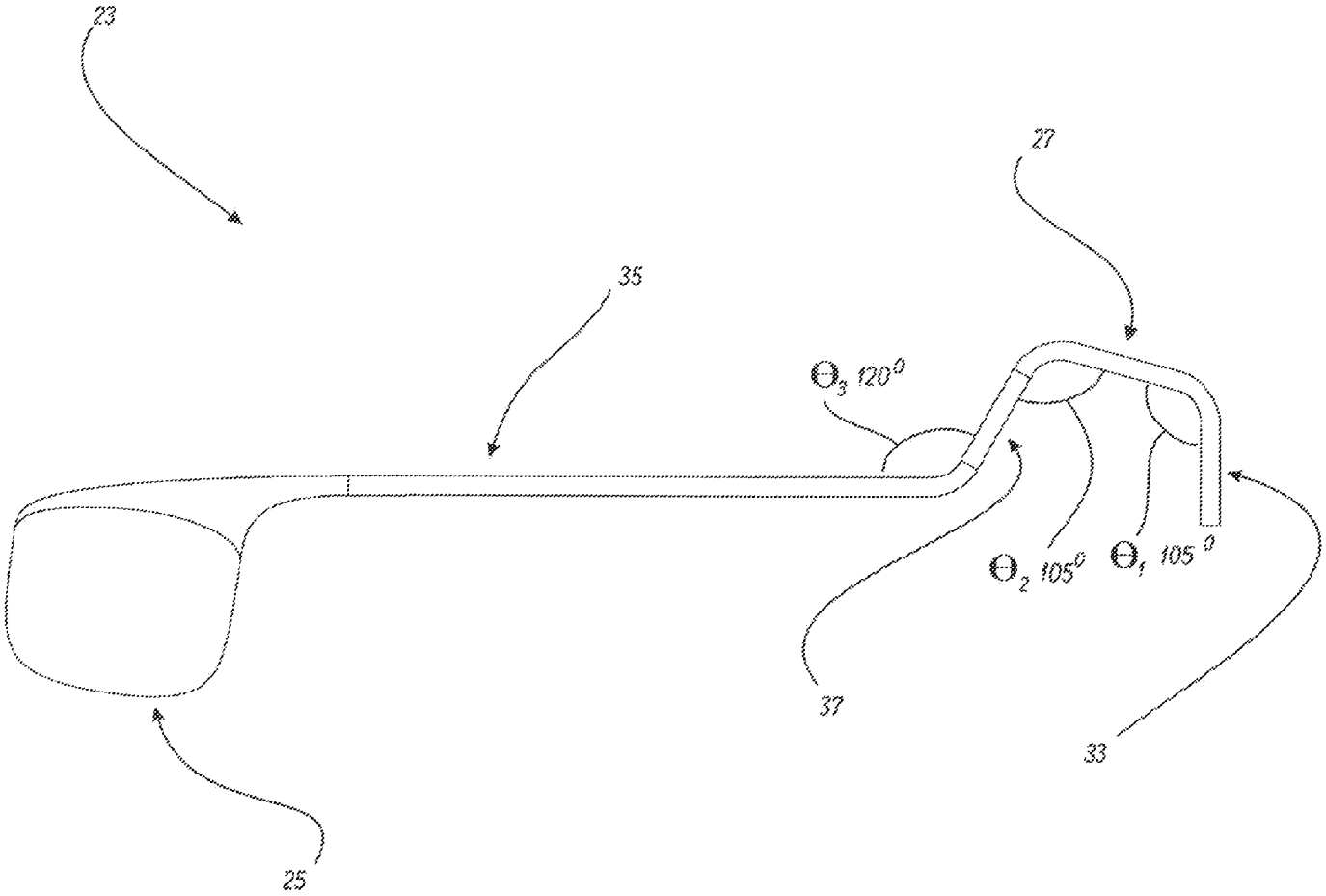
FIG. 9 is a view of an alternate embodiment of a preferred oar member of the boat of FIGS. 1 and 2.

FIG. 9 is a front (or back) view of an alternate oar member 23 (meaning the generic design used for right and left sides). As can be seen, the hand grip portion 27 is located closer towards the inner end of the oar member 23. The inboard shaft portion 33 is shorter and oriented more vertically than it is in the design of FIG. 3. The outboard shaft portion 35 is very straight, rather than the arched version of the design of FIG. 3. An intermediate shaft portion 27 interconnects the hand grip portion 37 and the inboard shaft portion 33. As shown, the inboard shaft portion 33, intermediate shaft portion 37 and hand grip portion 37 all combine to form an arcuate shape to provide the operator with the desired hand position, while also improving the torque generated to aid in the rowing and oar-lifting processes. This new design having the more vertical hand grip portion 37 allows for greater stroke angle while reducing the strain on the wrist.

The preferred angles between the various portions of the oar 23 shaft are 105 degrees between the inboard shaft portion 33 and the intermediate shaft portion 27, 105 degrees between the intermediate shaft portion 27 and the hand grip shaft portion 37, and 120 degrees (minus—in the opposite direction from the other two angles) between the hand grip shaft portion 37 and the outboard shaft portion 35.

A number of alternative or optional selections are expected, namely:

a. machined from aluminum, steel stock or extruded aluminum,
b. die-case from aluminum or steel,
c. injection molded (including fiber-reinforced plastics),
d. one-piece carbon fiber reinforced plastic (CFRP),
e. two-piece CFRP oar shaft and blade,
f. adjustable length oar shaft and/or adjustable blade angle, or
g. blades fabricated by injection molded plastic, and oar shafts made from aluminum.

For certain applications, a slightly different structural design has been found to be superior to the rowing apparatus [20] depicted above. The details of this alternate design are depicted and discussed below in connection with FIGS. 10-14.

Figure 10:
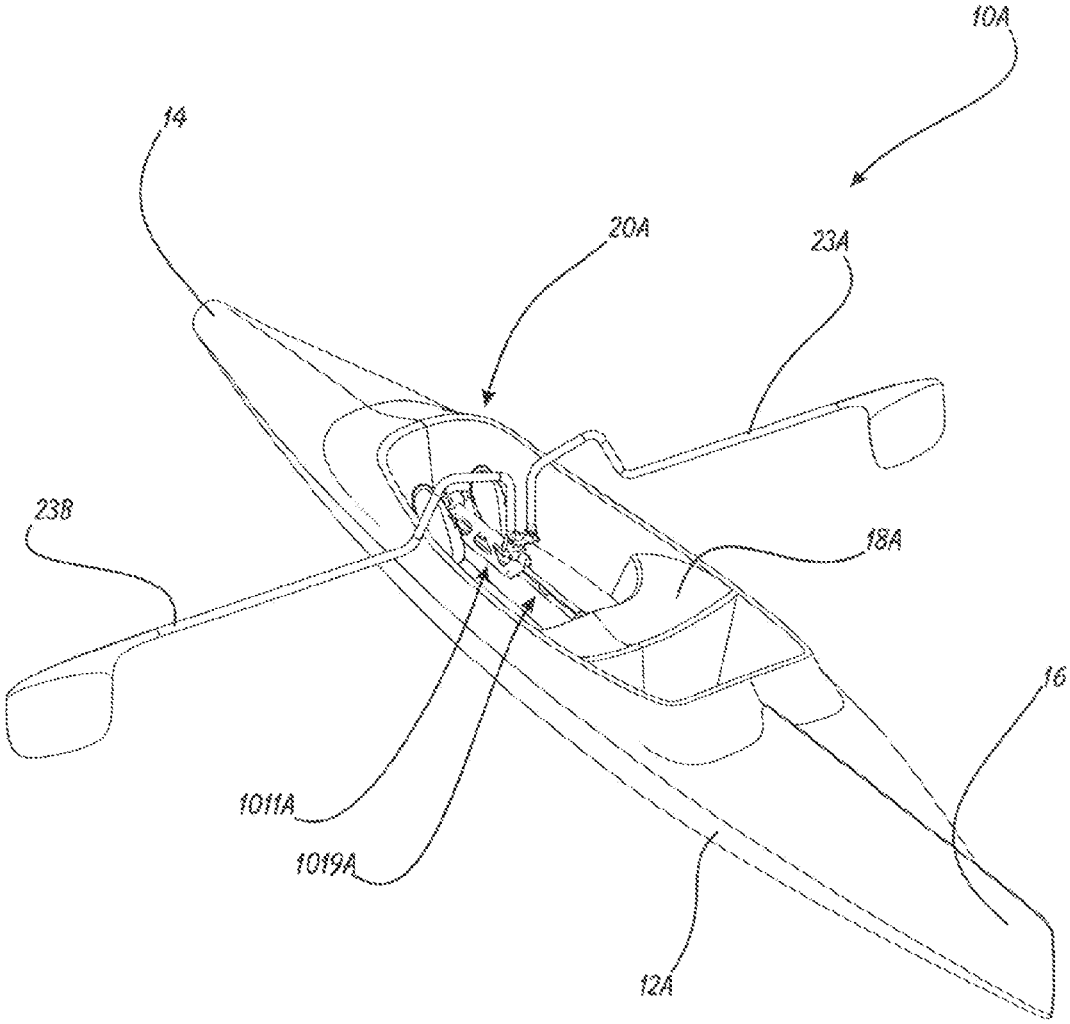
FIG. 10 is a rear perspective view of an alternate embodiment of the forward-rowable boat of the present invention.

FIG. 10 is a rear perspective view of an alternate embodiment of the forward-rowable boat 10A of the present invention. The boat 10A has an alternate version of the Forward-facing Rowing Apparatus 20A. Many of the features of the alternate version of the apparatus 20A are functionally identical to the first version [20] discussed herein. One key distinction is that the pivot point of the oar members is not stationary, but rather slides fore- and aft-during the rowing motion.

The hull 12A that is depicted in this version is similar to a conventional open cockpit kayak, and has a hollow, sealed hull. The seat 18A faces the bow 14 (and the forward-facing rowing apparatus 20A). The apparatus 20A has right and left oar members 23A, 23B, which are essentially unchanged from the design depicted in FIG. 9. A major change/addition present in this design 20A is related to the mounting track 1019A and base shuttle 1011A. This mounting track 1019A is longer than in the previous embodiment [10], and is configured to allow the shuttle 1011A to roll freely forward and backward (i.e. toward the bow 14 and stern 16, respectively). There are a pair of foot pedals attached to the shuttle 1011A that provides the user with additional leverage and power through use of their legs to push the shuttle 1011A forward during the stroking motion. This motion is depicted in FIGS. 11A-11D.

Figure 11A:
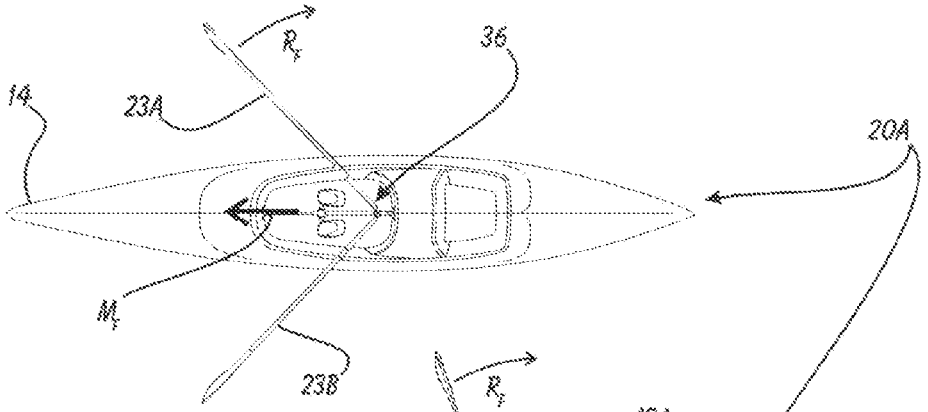
FIGS. 11A, 11B, 11C and 11D are top views of the boat of FIG. 10.
Figure 11B:
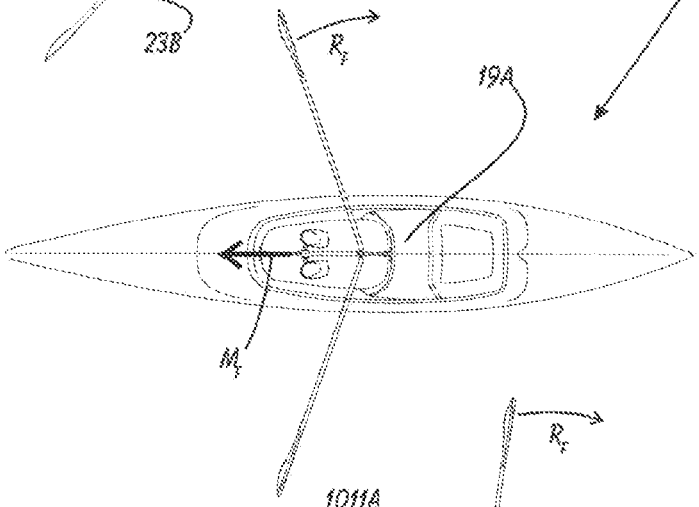

FIGS. 11A-11D are top views of the boat 10A of FIG. 10. In FIG. 11A, the oars 23A, 23B are at the beginning of a stroke (the initialize position), and are extended forward toward the bow 14. The central pivot point 36 is slid backward towards the seat 18A to the end of the mounting track [1019A]. The user then exerts rearward rowing force $R_F$ against the oars 23A, 23B (by pulling backwards on the oars), while simultaneously exerting forward movement force $M_F$ against the foot pads of the FFRA 20A. As the oars 23A, 23B proceed through the rowing motion, FIG. 11B shows that the pivot point 36 is moving away from the seat 18A, while the oars 23A, 23B move backward as the oars 23A, 23B pass through the rest position.

Figure 11C:
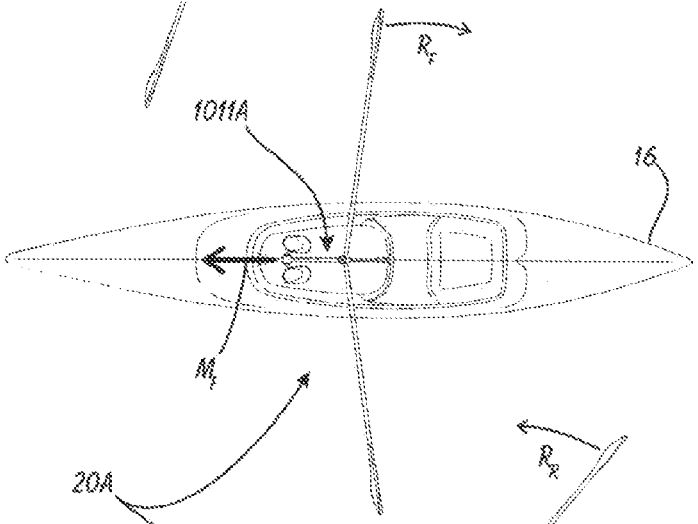
Figure 11D:
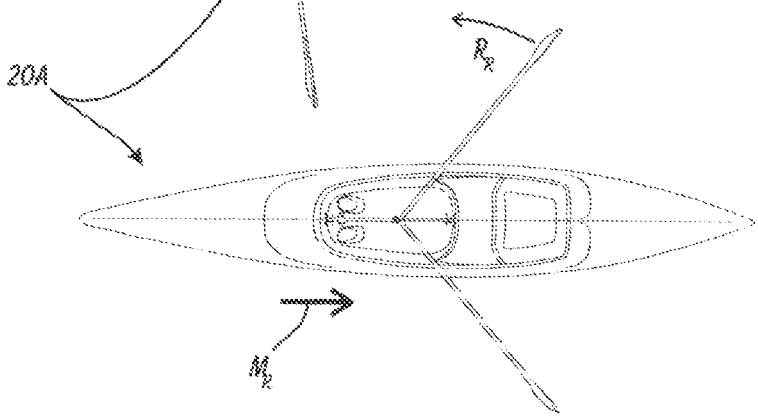

In FIG. 11C, the oars 23A, 23B and base shuttle 1011A have passed midpoint of their travel, and the rowing force $R_F$ is reaching its end for this stroke (the termination position). At FIG. 11D, the oars 23A, 23B have begun to return to the initialize position in response to return rowing force $R_R$. The oars 23A, 23B lift up by action of the lifting springs [109A, 110A], and the shape of the oar 23A, 23B blade. The shuttle 1011A is caused to slide aft by the user bending their knees and pulling their feet towards the seat 18A (creating return movement force $M_R$).

Figure 12B:
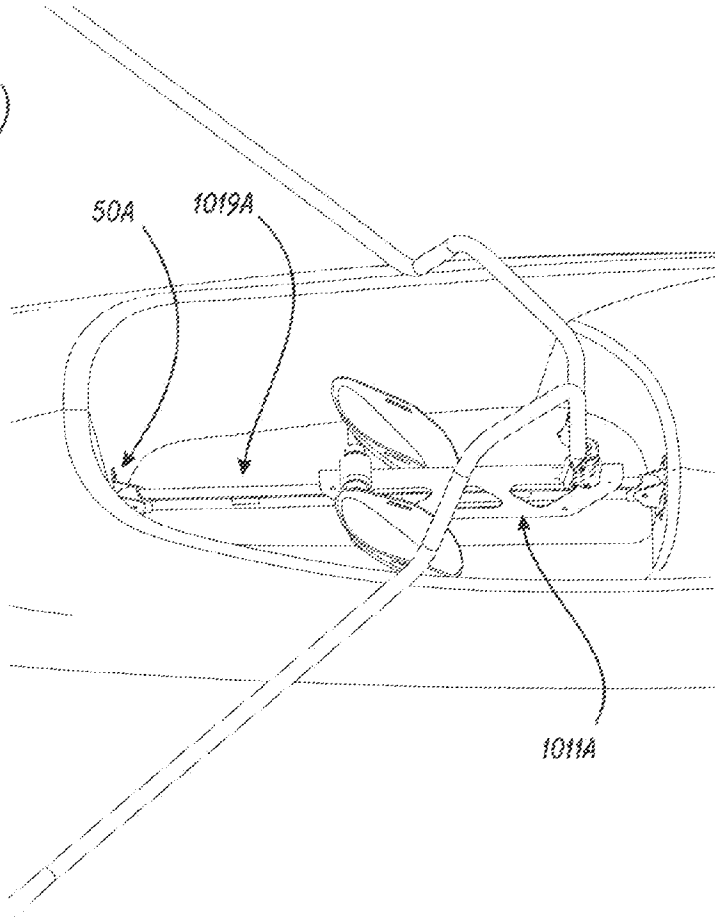
FIGS. 12A and 12B are partial side perspective views of the cockpit area of the boat of FIG. 10.
Figure 12A:
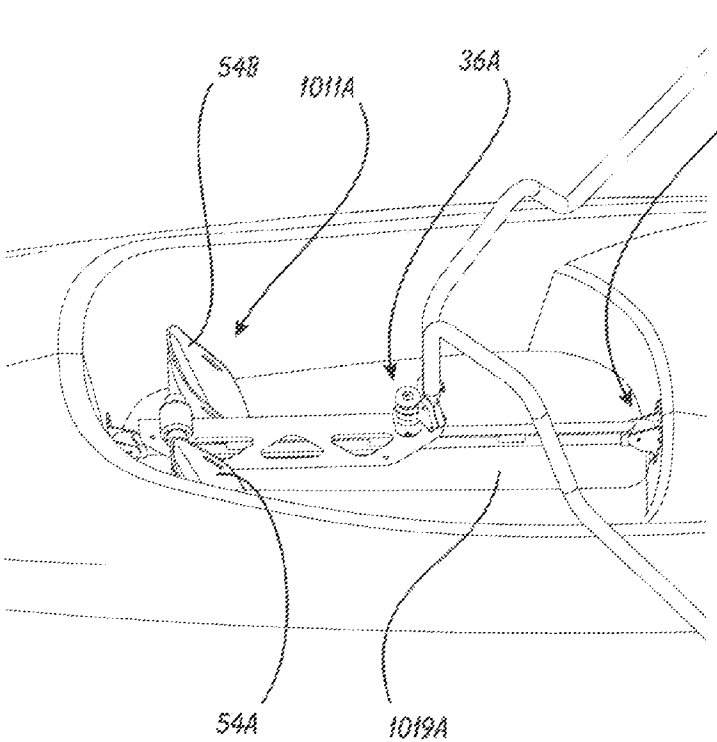

FIGS. 12A and 12B are partial side perspective views of the cockpit area of the boat [10A] of FIG. 10. In FIG. 12A, the shuttle 1011A and oars are in the initialize position, wherein the shuttle 1011A is at the far forward end of its travel along the mounting track 1019A. The footcups 54A, 54B have rotated down to accommodate the user's natural foot angle when the legs are fully extended. As can be seen here, the rear end of the mounting track 1019A attaches to the face of the seat 18A by rear attachment bracket 50B.

As seen in FIG. 12B, the shuttle 1011A and oars 23A, 23B are in the terminate position. The shuttle 1011A is at the rearmost part of its travel along the mounting track 1019A. As can be seen here, the footcups 54A, 54B are also rotated upwards so that they accommodate the user's natural foot angle when the knee is bent. The front mounting bracket 50A attaching the track 1019A to the hull [12A] at the front of the track 1019A is also shown. Further detail regarding this additional version is provided in FIG. 13.

Figure 13:
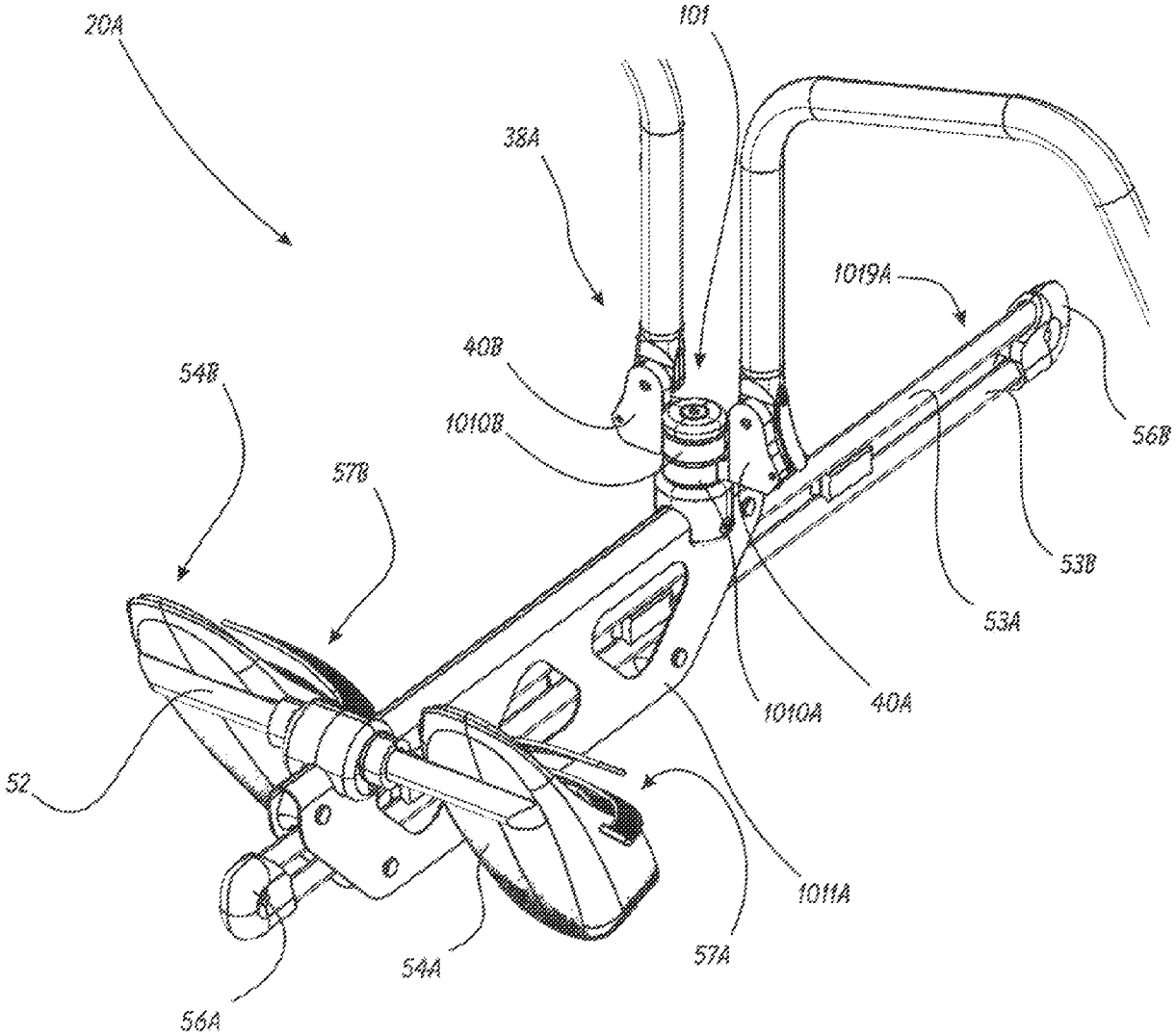
FIG. 13 is a partial cutaway perspective view of the alternate Forward Facing Rowing Apparatus of the boat of FIG. 10.

FIG. 13 is a partial cutaway perspective view of the alternate Forward Facing Rowing Apparatus 20A of the boat [10A] of FIG. 10. In this version, the mounting track 1019A is made from a pair of tubular rails—upper rail 53A and lower rail 53B. The base shuttle 1011A can roll freely along the length of the rails 53A, 53B (from left to right in this view). Front and rear rail 56A, 56B interconnect the two rails 53A, 53B, and also provide a mounting point for the front and rear attachment brackets [50A, 50B].

A pedal base element 52 (a rotating/pivoting bar) is attached to the base shuttle 1011A at its leading edge. First and second foot cups 54A, 54B extend from the base element 52, to provide the location for the user to place his or her feet. These foot cups 54A, 54B are fixed to a shaft that is held to the pedal base element with bushings to allow rotation. As discussed previously, part of the rowing method is for the use to pull his or her feet towards the seat [18A], to return the Apparatus 20A to the terminate position. To aid the user in this motion, each foot cup 54A, 54B is equipped with one or more straps 57A, 57B. The straps 57A, 57B are used to restrain the user's feet to the foot cups 54A, 54B.

Figure 14:
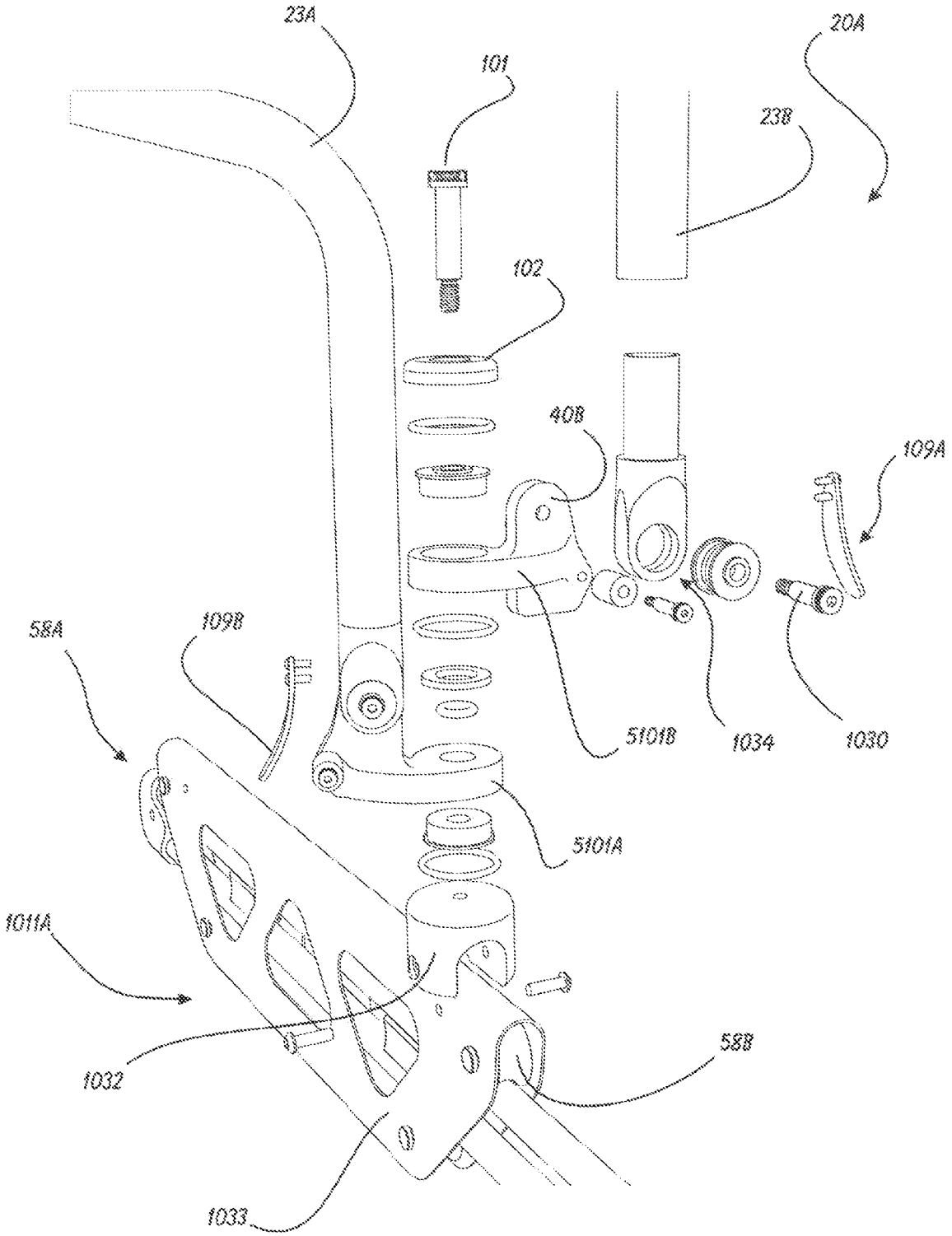
FIG. 14 is a partial exploded perspective view of the alternate Forward Facing Rowing Apparatus of FIG. 13.

The central hub assembly 38A is very similar in structure to the prior-described design, and is discussed in additional detail below in connection with FIG. 14. FIG. 14 is a partial exploded perspective view of the alternate Forward Facing Rowing Apparatus 20A of FIG. 13. The base shuttle 1011A has a frame 1033 that envelopes the upper and lower rails [53A, 53B]. The frame 1033 rides/slides (actually rolls) along the rails [53A, 53B] on two or more rollers 58A, 58B that are attached to the frame 1033.

A pivot base 1032 extends upwardly from the frame 1033, and provides a structure to which the center pivot screw 101 attaches the other elements. Each oar 23A, 23B is pivotally attached to an oar mounting tab 40A, 40B by oar pivot screws 1030. The tabs 40A, 40B extend outwardly from hub collars 5101A and 5101B, which pivot around the pivot base 1032. The main pivot has two angular contact bearings pressed into each hub collar top and bottom with a single thrust bearing in between the two hub collars. The oar end loops have two angular contact bearings each pressed in. Using shims for clearance adjustment this provides a zero free play condition.

Just as with the original design, lifting springs 109A and 109B create upward biasing force on the end loop 1034 of each oar 23A, 23B, from a roller wheel mounted to each hub tab. While the specific structure of the individual elements of the central hub assembly 38A have changed somewhat as compared to the design of FIGS. 1-9, their operation is essentially the same.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A boat, comprising:

a hull defined by a bow at one end, a stern at an opposing end, and a seat disposed between said bow and stern;

a forward-facing rowing apparatus attached to said hull between said seat and said bow, said forward-facing rowing apparatus comprising:

a central hub assembly comprising a single vertical pivot shaft element and a pair of oar mounting elements pivotally mounted to said single vertical pivot shaft element and each defined by an oar mounting tab extending therefrom;

right and left oar members, each said oar member defined by:

a pivot cap pivotally attached to one said oar mounting tab and defining a horizontal shaft element interconnecting each said pivot cap and mounting tab;

an inboard shaft portion extending upwardly from said pivot cap;

a hand grip shaft portion, extending at an angle of between 140 and 160 degrees from said inboard shaft portion;

an outboard shaft portion extending from said hand grip shaft portion; and terminating in a blade extending from said outboard shaft portion.

2. The boat of claim 1, wherein said outboard shaft portion of each said oar member extends at an angle of between 75 and 105 degrees from said inboard shaft portion.

3. The boat of claim 2, wherein each said oar member is further defined by an intermediate shaft portion between said inboard shaft portion and said hand grip shaft portion, said intermediate shaft portion intersects said inboard shaft portion at an angle of between 85 and 115 degrees, and said hand grip shaft portion intersects said intermediate shaft portion at an angle of between 85 and 115 degrees.

4. The boat of claim 1, wherein said central hub assembly further comprises first and second biasing elements, each said biasing element associated with each pair of said oar mounting tabs and pivot caps to bias said caps to pivot relative to said mounting tabs.

5. The boat of claim 4, wherein said forward-facing rowing apparatus is slidingly attached to a mounting track attached to said hull.

6. The boat of claim 5, wherein said central hub assembly extends from a base shuttle, said base shuttle slidingly attached to said mounting track.

7. The boat of claim 6, wherein said base shuttle is further defined by right and left foot cups extending from said base shuttle.

8. The boat of claim 7, wherein each said base shuttle is defined by a shuttle frame, said shuttle frame further defined by one or more rollers supporting said shuttle frame on said mounting track.

9. A forward-facing rowing apparatus, comprising:

a central hub assembly comprising a single vertical pivot shaft element and a pair of oar mounting elements pivotally mounted to said single vertical pivot shaft element and each defined by an oar mounting tab extending therefrom;

right and left oar members, each said oar member defined by:

a pivot cap pivotally attached to one said oar mounting tab and defining a horizontal shaft element interconnecting each said pivot cap and mounting tab;

an inboard shaft portion extending upwardly from said pivot cap;

a hand grip shaft portion, extending at an angle of between 140 and 160 degrees from said inboard shaft portion;

an outboard shaft portion extending from said hand grip shaft portion; and terminating in a blade extending from said outboard shaft portion.

10. The forward-facing rowing apparatus of claim 9, wherein said outboard shaft portion of each said oar member extends at an angle of between 75 and 105 degrees from said inboard shaft portion.

11. The forward-facing rowing apparatus of claim 10, wherein each said oar member is further defined by an intermediate shaft portion between said inboard shaft portion and said hand grip shaft portion, said intermediate shaft portion intersects said inboard shaft portion at an angle of between 85 and 115 degrees, and said hand grip shaft portion intersects said intermediate shaft portion at an angle of between 85 and 115 degrees.

12. The forward-facing rowing apparatus of claim 9, wherein said central hub assembly further comprises first and second biasing elements, each said biasing element associated with each pair of said oar mounting tabs and pivot caps to bias said caps to pivot relative to said mounting tabs.

13. The forward-facing rowing apparatus of claim 12, wherein said forward-facing rowing apparatus is slidingly attached to a mounting track attached to said hull.

14. The forward-facing rowing apparatus of claim 13, wherein said central hub assembly extends from a base shuttle, said base shuttle slidingly attached to said mounting track.

15. The forward-facing rowing apparatus of claim 14, wherein said base shuttle is further defined by right and left foot cups extending from said base shuttle.

16. The forward-facing rowing apparatus of claim 15, wherein each said base shuttle is defined by a shuttle frame, said shuttle frame further defined by one or more rollers supporting said shuttle frame on said mounting track.

17. The forward-facing rowing apparatus of claim 16, wherein said right and left foot cups are pivotally attached to said base shuttle.

18. The boat of claim 6, wherein said right and left foot cups are pivotally attached to said base shuttle.

* * * * *